US005822794A

United States Patent [19]

Allred

[11] Patent Number: 5,822,794

[45] Date of Patent: Oct. 20, 1998

[54] GRIPPING FOOTBALL SHIRT

[76] Inventor: Brian M. Allred, 2411 Larkspur La. #38, Sacramento, Calif. 95825

[21] Appl. No.: 789,522

[22] Filed: Jan. 27, 1997

[51] Int. Cl.[6] ..... A41D 1/00

[52] U.S. Cl. ..... 2/115; 2/69

[58] Field of Search ..... 2/115, 106, 108, 2/85, 93, 94, 51, 48, 69, 81, 125, 455, 456, 458, 113, 159

[56] References Cited

U.S. PATENT DOCUMENTS

| | | | |
|---|---|---|---|
| 1,489,754 | 4/1924 | O'Shea | 2/113 |
| 1,516,981 | 11/1924 | O'Shea | 2/115 |
| 2,063,469 | 12/1936 | Smith | 2/94 |
| 2,302,368 | 11/1942 | Evans | 2/94 |
| 2,493,370 | 1/1950 | Smith | 2/94 |
| 3,096,523 | 7/1963 | Bruchas | 2/159 |

*Primary Examiner*—Gloria M. Hale
*Attorney, Agent, or Firm*—Mark C. Jacobs, Esq.

[57] ABSTRACT

The gripping football shirt is comprised of lycra, cotton, nylon, polypropylene or spandex blends with neoprene strips mounted on the inside of the anatomical arms. Then neoprene strips give a player a non-slip grip upon the football during retrieving and possession. The shirt also allows for increased protection against skin abrasions while playing on natural and artificial surfaces.

5 Claims, 1 Drawing Sheet

GRIPPING FOOTBALL SHIRT

CROSS REFERENCE TO RELATED APPLICATION

Not applicable

BACKGROUND OF THE INVENTION

This invention relates to griping equipment for football shirts utilized by players, in organized football leagues during play.

Tackified leather and other football gripping equipment are becoming more prominent pieces of player apparel. Such existing equipment aides in maintaining possession of the football during play and protection of the anatomical arms. Other available gripping football equipment is designed to aid the hands/wrist with gripping focus, and may be accompanied by padded arm and or elbow protection.

Some of the disadvantages of current football gripping equipment are as follows:

a. Players dislike gloves on their hands, b. Players, and I was one in the N.F.L., dislike forearm/elbow protection that is currently accompanied by bulky cumbersonme padding, and c. tackified leather becomes slippery when saturated with water.

It is an object of this invention to provide an improved football shirt, which shirt is worn beneath a football jersey.

Another object is to provide a gripping material to aid in ball retention, while providing anatomical arm protection, without the hindrance of bulky material.

Other objects of the invention will in part be obvious and will in part appear hereinafter.

The invention accordingly comprises the article possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

This invention is directed to aiding a player's grip during possession of the ball, and helping to reduce abrasions to the skin which are created by contact with the playing surface by providing a reinforced football shirt with a section of neoprene fabric sewn or otherwise attached to the exterior surface of the conventional shirt at two mirror image strategic locations on the shirt sleeve.

DETAILED DESCRIPTION OF THE INVENTION

Figure 1:
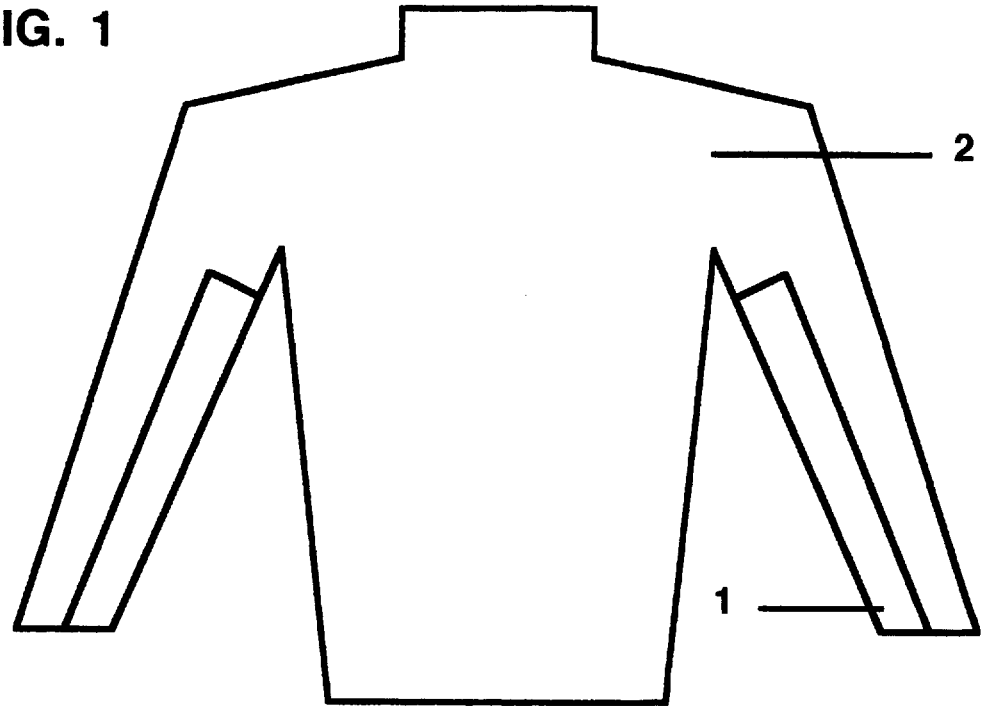
FIG. 1 is a front elevational view of the football gripping shirt of this invention.
Figure 2:
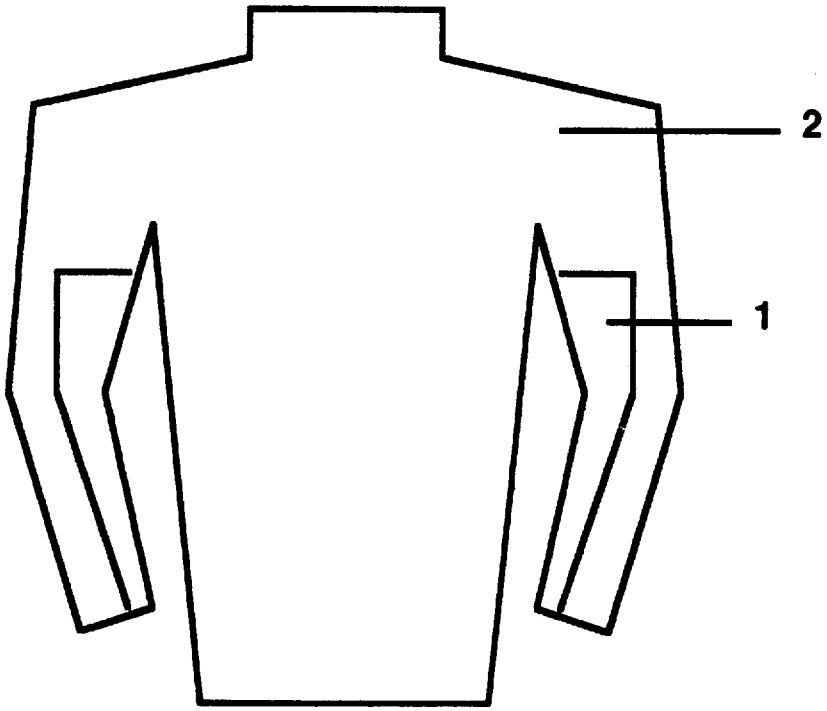
FIG. 2 is a rear elevational view of the football gripping shirt of FIG. 1.

The football gripping shirt of this invention as seen in FIGS. 1 and 2 which comprises any conventional fabric pull over close fitting shirt with long sleeves, 2, includes a section of neoprene overlaid upon and stitched to or otherwise attached, on the inside portion of each anatomical arm of the shirt. As can be seen from FIG. 2, the triceps and biceps muscle areas of the arm of the shirt are covered over by the overlaid neoprene section, 1. Today's football shirts are made of such fabrics as spandex, cotton, nylon and polypropylene among others and blends thereof. Breathable cloth or fabric is suggested to ease the passage of perspiration, and the technology to make such fabrics is deemed conventional. The placement of the neoprene section provides for the neoprene to cover from the wrist/forearm to the lower portion of the upper arm.

Those knowledgeable in football are aware that the best way to carry the ball is to bend the elbow, and hold the bent arm next to the body with the ball resting in the crook of the arm with the ulna bone down and the radial bone up, and the ball tucked in between the elbow and body, resting on the arm. Since the area of the shirt covered by neoprene will be in contact with the ball when the arm is so moved, this will allow for a firmer non-slip grip on the football during play. Typically the long sleeve shirt may be made of a close fitting, breathable cloth or fabric. Among such, mention may be made of spandex, cotton, nylon, polypropylene, and spandex blends. In addition, the neoprene section 1, will provide increased protection for the anatomical arm of the shirt and the arm of the wearer against abrasions when playing on natural and aritifical surfaces.

Since certain changes may be made in the described article without departing from the scope of the invention herein involved, it is intended that all matter contained in the above description and shown in the accompanying drawings shall be interpreted as illustrative and not in a limiting sense.

I claim:

1. A football player's long sleeve shirt to be worn beneath a numbered jersey which shirt is adapted to improve the gripability and retention of a football, when a football is held by the wearer against at least one clothed arm by the wearer, which shirt comprises:

a conventional long sleeve football shirt having two anatomical arm sections for a close fit on both, of both upper and lower arms of the wearer, said shirt having two spaced sections of neoprene mounted externally on the two arm sections of the shirt to substantially cover the triceps and biceps muscle areas of each arm of the wearer.

2. The football player's shirt as in claim 1 wherein the anatomical arms of the shirt have an inside portion and an outside portion, and the neoprene sections are mounted on the inside portion of the anatomical arm of the shirt.

3. A football player's long sleeved shirt, the arms of which have an internal portion and an external portion, said shirt adapted to improve the gripability of a football when a football is carried by the wearer, which shirt comprises:

a breathable fabric shirt, having neoprene sections sewn on the internal portion of the external surface of the arms of each of the two sleeves covering from the wrist and forearm to the lower portion of the upper arm of the wearer.

4. The shirt of claim 3 wherein the sleeves of the shirt are anatomical in fit.

5. A football player's shirt adapted to improve the gripability of a football when a football is carried by the wearer, which shirt comprises:

a long sleeved fabric shirt having internal and external surfaces on each sleeve, said shirt made of fabric selected from the group consisting of spandex, nylon, polypropylene and spandex blends, which shirt's sleeves have an internal portion and an external portion, and which shirt has neoprene sections sewn on the internal portion of the external surface of the arms of each of the two sleeves covering from the wrist and forearm to the lower portion of the upper arm of the wearer.

* * * * *